US011162760B1

(12) United States Patent
Cragg

(10) Patent No.: US 11,162,760 B1
(45) Date of Patent: Nov. 2, 2021

(54) WEAPON RETENTION DEVICE

(71) Applicant: James Victor Cragg, Carson, CA (US)

(72) Inventor: James Victor Cragg, Carson, CA (US)

( * ) Notice: Subject to any disclaimer, the term of this patent is extended or adjusted under 35 U.S.C. 154(b) by 0 days.

(21) Appl. No.: 16/939,407

(22) Filed: Jul. 27, 2020

(51) Int. Cl.
*F41C 33/04* (2006.01)

(52) U.S. Cl.
CPC ..... *F41C 33/046* (2013.01)

(58) Field of Classification Search
CPC ..... F41C 33/046; F41C 33/00; F41C 33/001; F41C 33/002; F41C 33/006; F41C 33/0209; F41C 33/041
See application file for complete search history.

(56) References Cited

U.S. PATENT DOCUMENTS 1,601,963 A * 10/1926 Arth ..... F41C 33/0227 224/193
3,847,315 A * 11/1974 Bianchi ..... F41C 33/046 224/616
5,294,031 A * 3/1994 Volpei ..... A45F 3/00 224/192
7,594,354 B1 * 9/2009 Chadwick ..... A01K 97/10 43/21.2
10,420,413 B1 * 9/2019 Klymenko ..... A45C 3/00
10,775,130 B1 * 9/2020 Cass ..... F41C 33/007
11,029,126 B1 * 6/2021 Silva ..... F41C 33/04
2008/0257929 A1 * 10/2008 Cragg ..... A45F 3/14 224/649
2010/0276464 A1 * 11/2010 Hirt ..... F41C 33/0245 224/243
2014/0183234 A1 * 7/2014 Hudspeth ..... B60R 7/14 224/275
2020/0096289 A1 * 3/2020 Fischer ..... F41C 33/046

* cited by examiner

*Primary Examiner* — Corey N Skurdal
(74) *Attorney, Agent, or Firm* — Tobin Hobbs

(57) ABSTRACT

Disclosed is a weapon retention device for retaining a weapon on the personal gear of a user. At the core of the weapon retention device is a "U" shaped clamp. The clamp provides a friction force around the frame of the weapon. The weapon retention device may have various secondary and tertiary retention mechanisms. In some embodiments, the weapon retention device may have components which surround the weapon and any sighting optic which may be attached. The components which surround the weapon and optic may provide protection and retention of the weapon.

20 Claims, 16 Drawing Sheets

WEAPON RETENTION DEVICE

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Field

The present invention relates to gear worn on the person, and in particular, weapon retention devices worn on the person by military personnel and first responders.

2. Background

Devices for weapons retention are well known in the art. For military and law enforcement personnel, they have a variety of formats. Some may be as simple as a single strap with mechanical devices for creating loops on either end. Others are more complex. Among the additional complexities may be addition means of retention for added security of retaining the weapon to the person. For example, in addition to a cloth strap, there may also be a metal fastener as a secondary attachment. Some retention devices are even cases, such as holsters, which serve to retain weapons to the person.

Weapon retention has an obvious goal, namely, to keep a weapon with the personnel so that the personnel can use it at need. Because personnel generally don't have a continuous need to employ a weapon, the personnel also need some way to carry the weapon. Weapon retention devices fill that rather straightforward need. However, in recent years, this need has been complicated. Many weapons, both lethal and non-lethal have been fitted with advanced optics for more accurate and precise targeting. One ironic outcome is that the optics are sometimes more expensive than the weapon itself. Moreover, in many cases, while the weapon may take a large amount of abuse and continue to function, the optic may be more delicate. In these cases, not just any basic weapons retention device will serve the purpose. Special consideration must be given to prevent the weapon from moving in an undesired fashion. For example, the optic may be damaged by banging against the body or other equipment.

Further, attention must be paid to the fact that the weapon being retained may be a secondary weapon. Thus, the retention device must be one that allows employment of a primary weapon. This necessarily limits the locations where the retention device may retain the weapon. It further controls how the weapon is retained. In most instances, it must be retained close to the body in order to allow freedom of movement of the person and other equipment the person is employing.

For the foregoing reasons, there is a need for a weapons retention device which allows freedom of movement for employment of other weapons and further protects the weapon being employed.

BRIEF SUMMARY

Disclosed herein is a weapon retention device for carrying a weapon on a person. The weapon retention device may include a clamp. The clamp may include a first side. The first side may be substantially planar. The clamp may also include a second side. The second side may have a first straight section and a second straight section, with an angled section between the first straight section and the second straight section. The angled section may cause the second section to be closer to the first side than the first section. The clamp may further include a curved portion, which may connect the first side and the second side. The first side and second side may define an open end. The weapon retention device may further include a secondary retention strap. The secondary retention strap may be attached to the first side of the clamp, and the secondary retention strap may have a fastener for selectably engaging on the second side of the clamp. The weapon retention device may further include a mounting panel attached to the clamp. The mounting panel may include a plurality of straps for attaching the weapon retention device to other equipment. The weapon retention device may further include a grip loop attached to the clamp. The grip loop may be made of an elastic material and may be sized to allow a user to grasp the grip loop and move it to surround a grip of a weapon. Further disclosed is that when the weapon is placed in the clamp, the clamp may provide a friction force on the frame and trigger guard of the weapon. The secondary retention strap may be engaged with the second side of the clamp so that the secondary retention strap crosses the open end, and the grip loop may be moved to surround and abut the grip of the weapon.

Further disclosed herein is a method for manufacturing a weapon retention device for carrying a weapon on a person. A clamp may be formed. The clamp may include a first side. The first side may be substantially planar. The clamp may also include a second side. The second side may have a first straight section and a second straight section, with an angled section between the first straight section and the second straight section. The angled section may cause the second section to be closer to the first side than the first section. The clamp may further include a curved portion, which may connect the first side and the second side. The first side and second side may define an open end. A secondary retention strap may be attached to the first side of the clamp, and the secondary retention strap may have a fastener for selectably engaging on the second side of the clamp. A mounting panel may be attached to the clamp. The mounting panel may include a plurality of straps for attaching the weapon retention device to other equipment. A grip loop may be attached to the clamp. The grip loop may be made of an elastic material and may be sized to allow a user to grasp the grip loop and move it to surround a grip of a weapon. Further disclosed is that when the weapon is placed in the clamp, the clamp may provide a friction force on the frame and trigger guard of the weapon. The secondary retention strap may be engaged with the second side of the clamp so that the secondary retention strap crosses the open end, and the grip loop may be moved to surround and abut the grip of the weapon.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
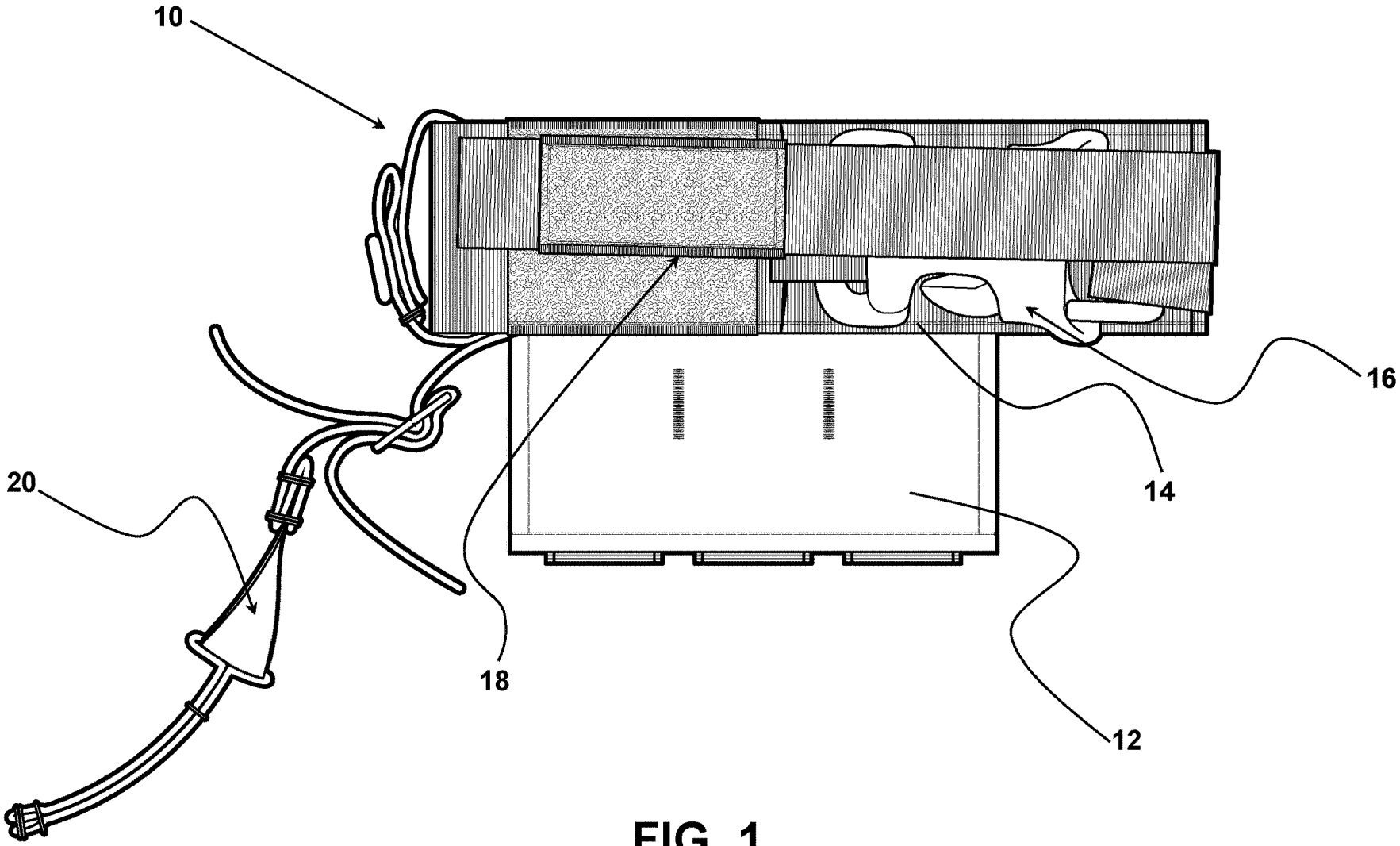
FIG. 1 shows a perspective view of a first embodiment of the weapon retention device.
Figure 2:
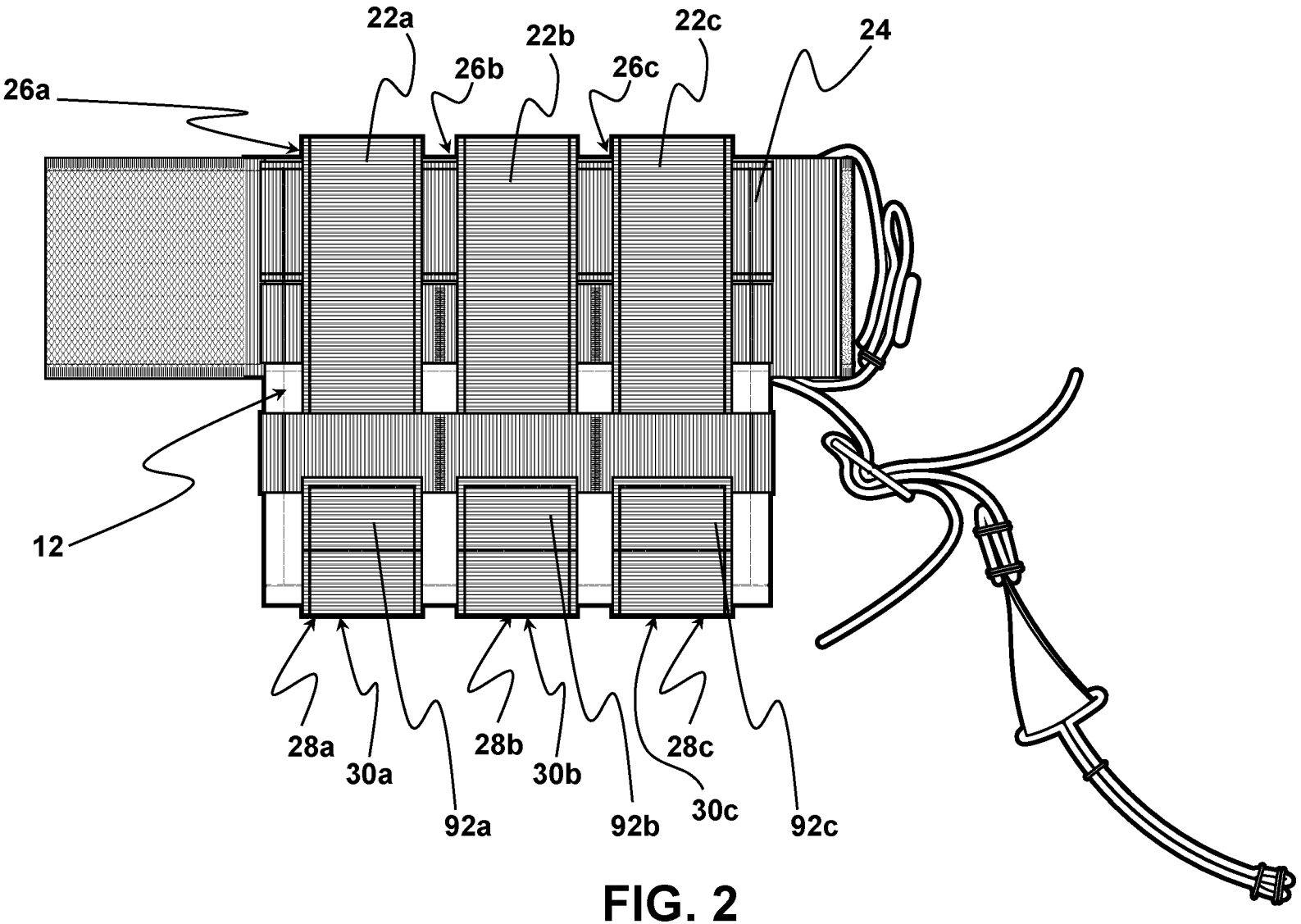
FIG. 2 shows a plan view of the opposite side of the weapon retention device shown in FIG. 1.
Figure 3:
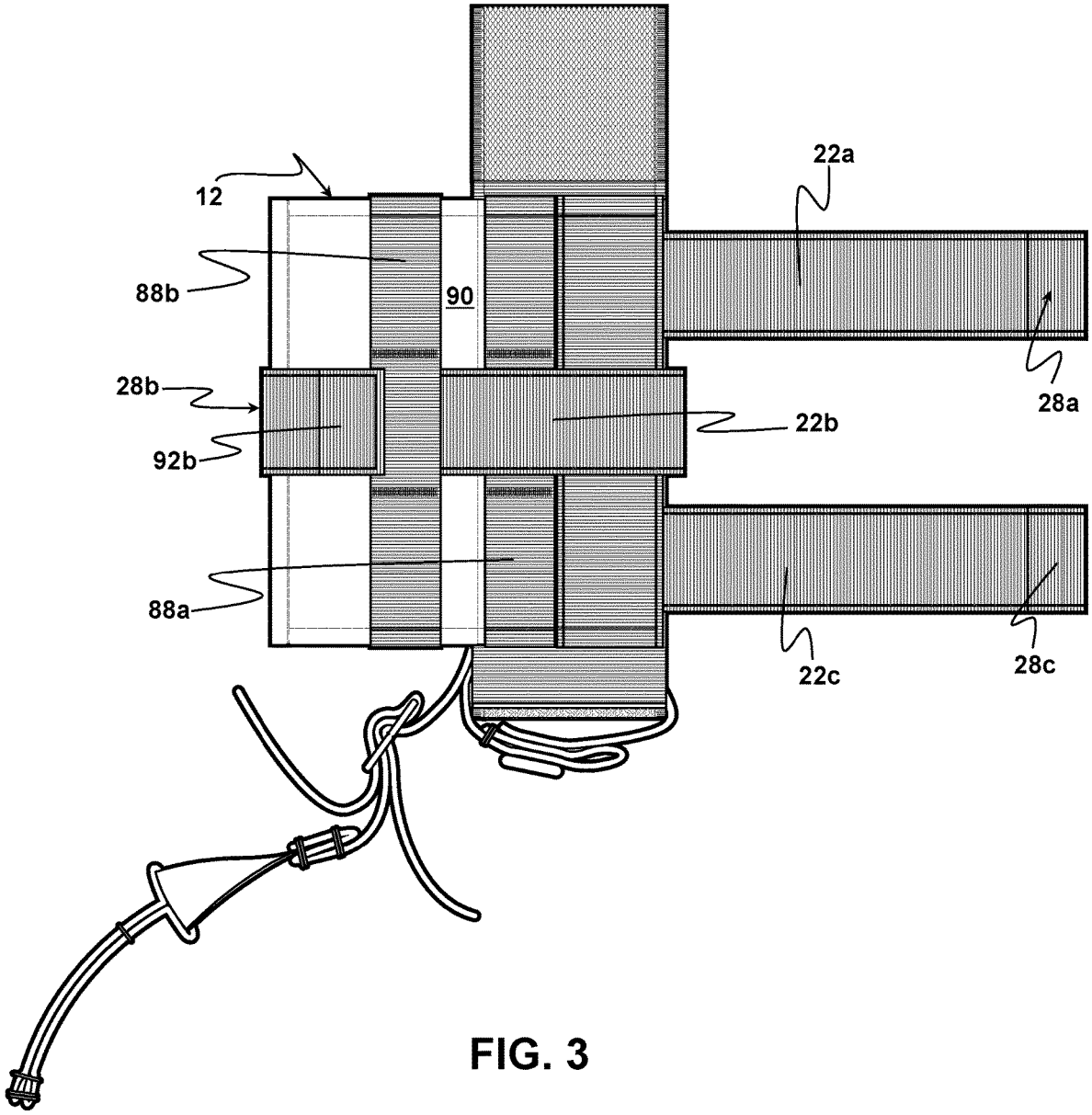
FIG. 3 shows the plan view of FIG. 2 with the attachment straps disengaged.
Figure 4:
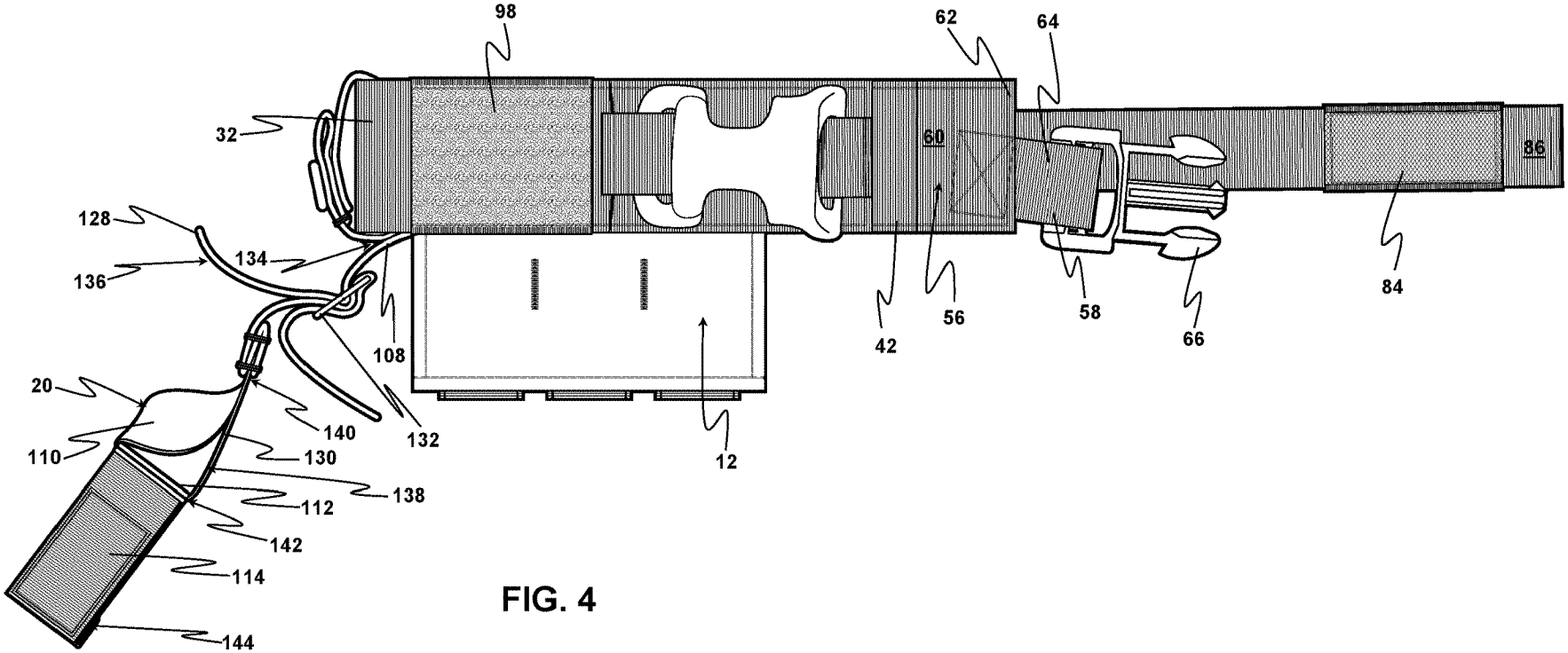
FIG. 4 shows a perspective view of the first embodiment with the primary and secondary fasteners disengaged.
Figure 5:
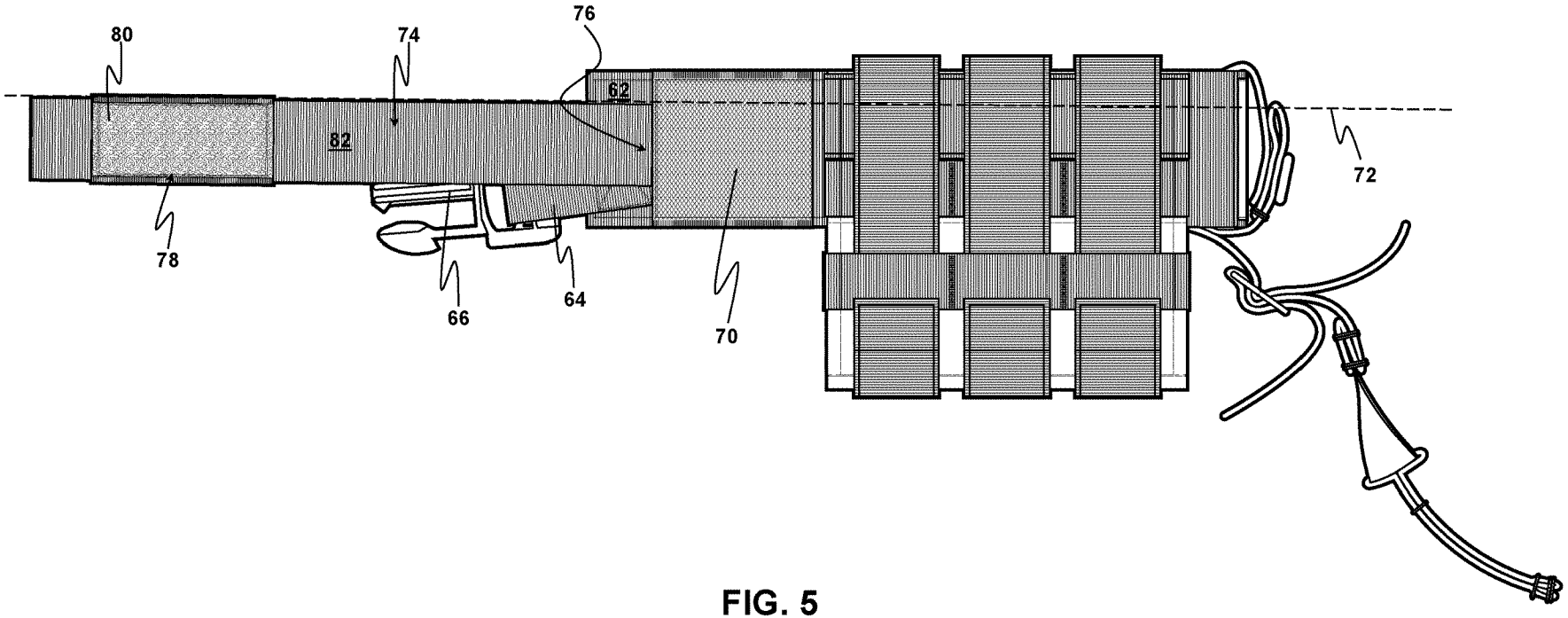
FIG. 5 shows a plan view of the opposite side of the weapon retention device of FIG. 4.
Figure 6:
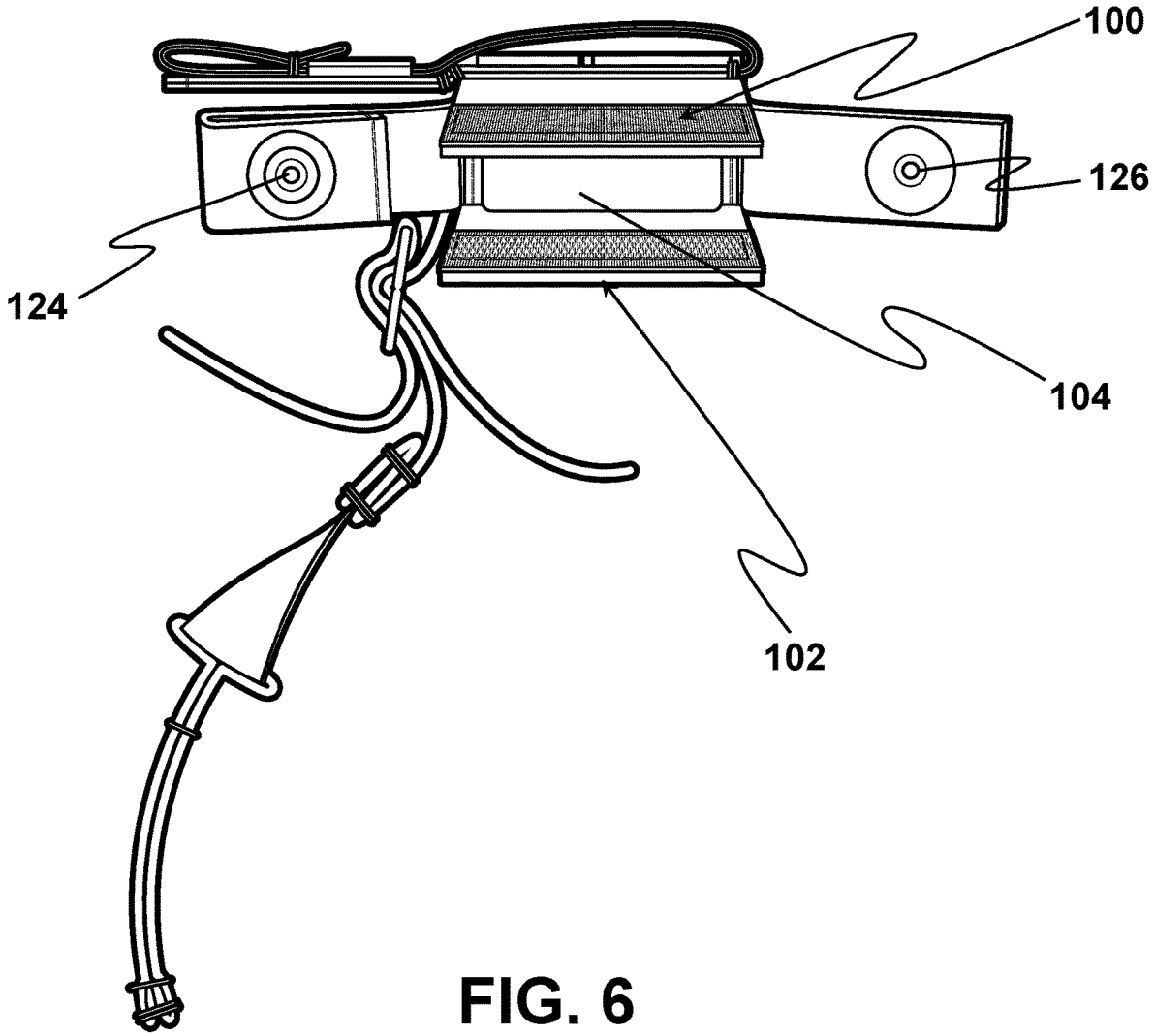
FIG. 6 shows a detail view of the opening to remove the clamp.
Figure 7:
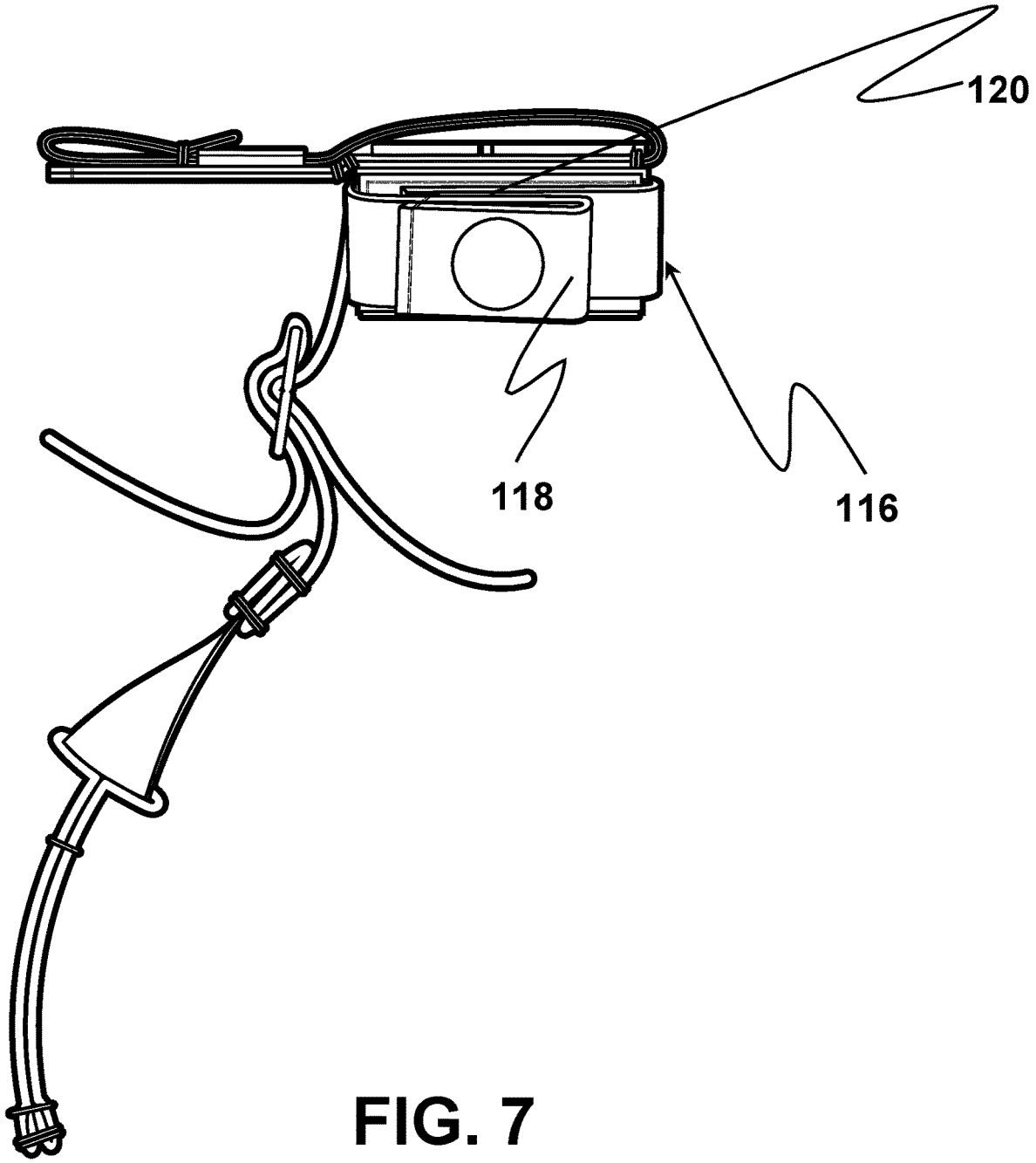
FIG. 7 shows a detail view of the clamp opening closed.
Figure 8:
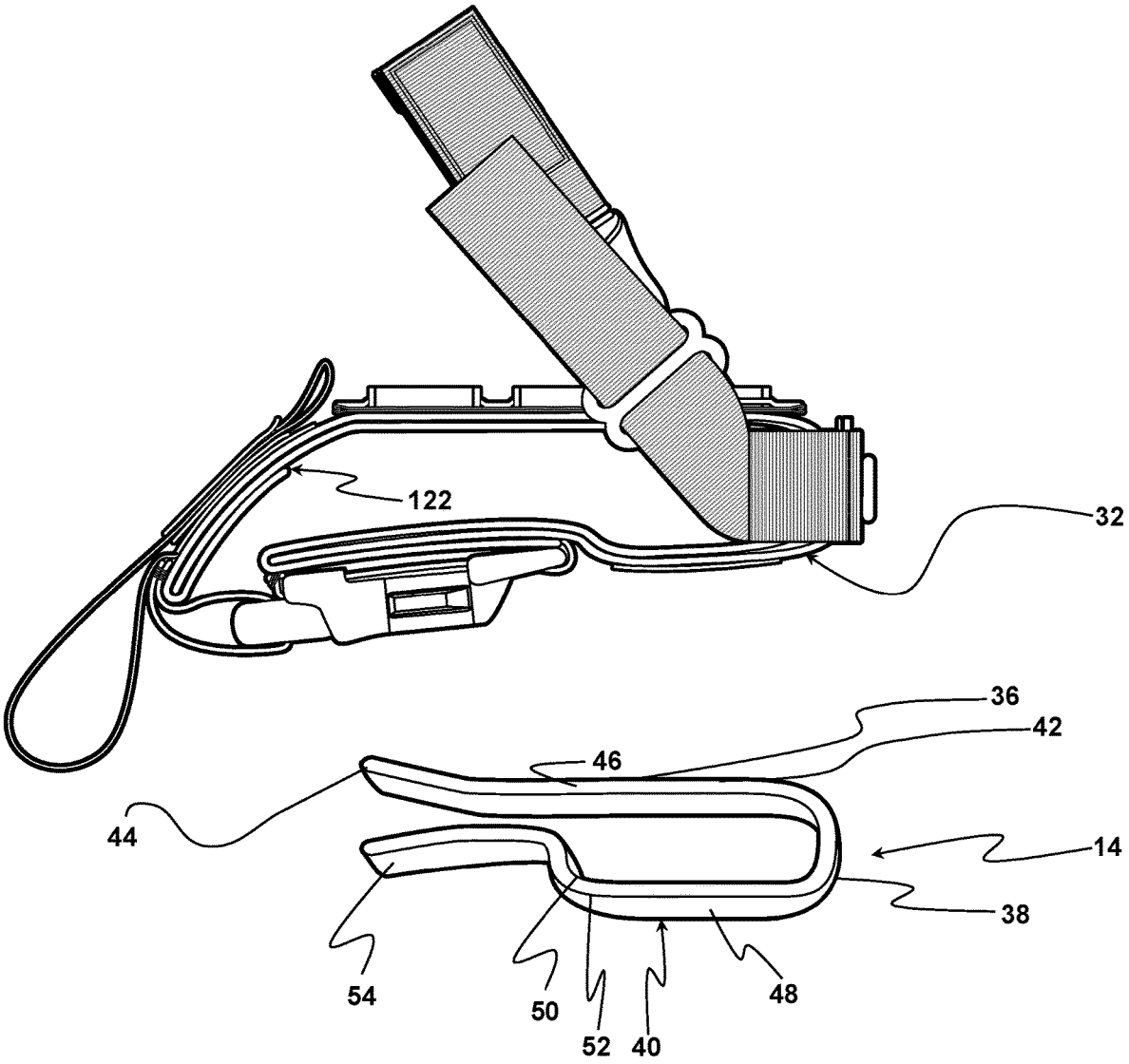
FIG. 8 shows a perspective view of the clamp removed from the clamp cover.
Figure 9:
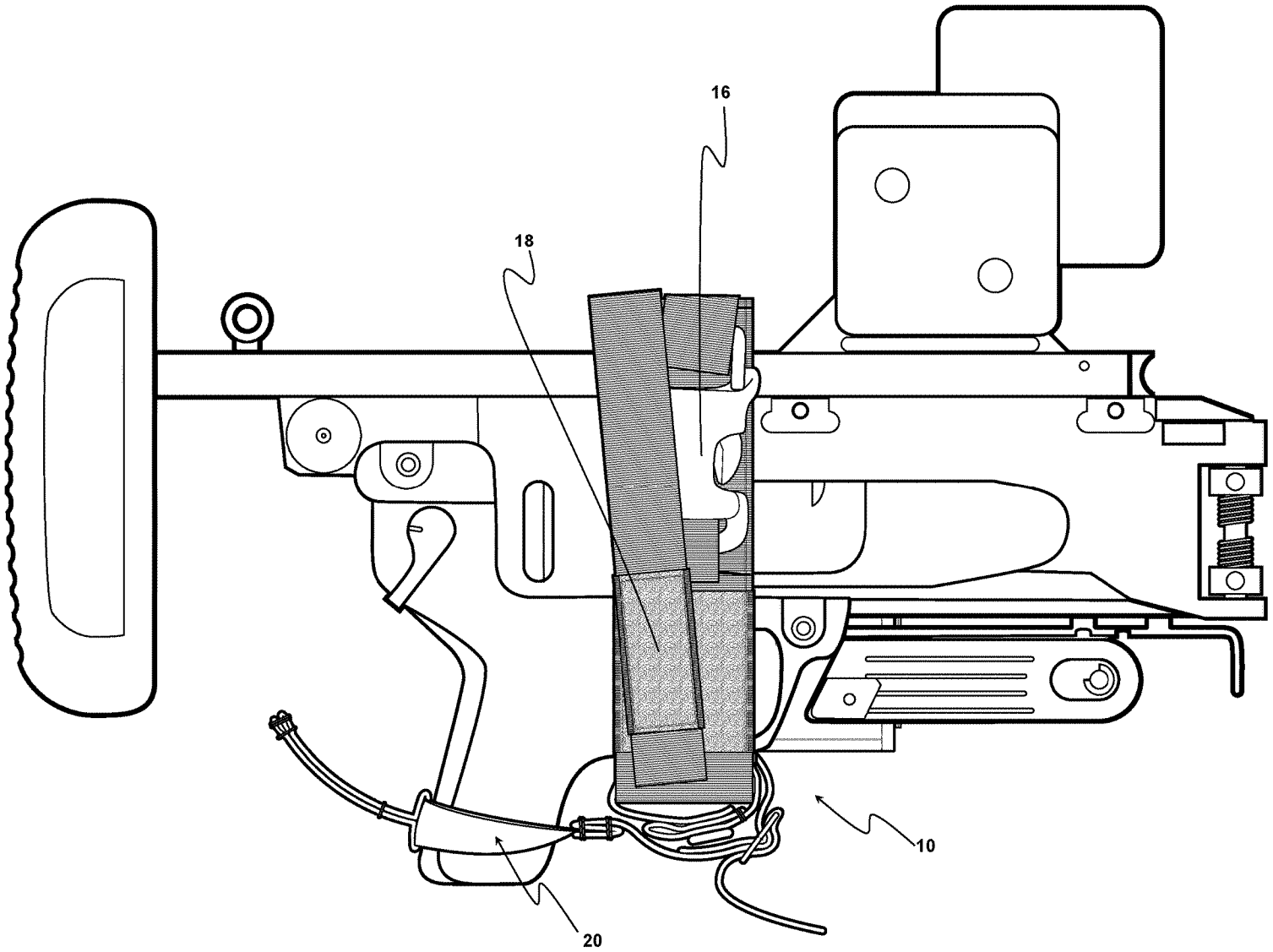
FIG. 9 shows a perspective view of a weapon placed in the weapon retention device.
Figure 10:
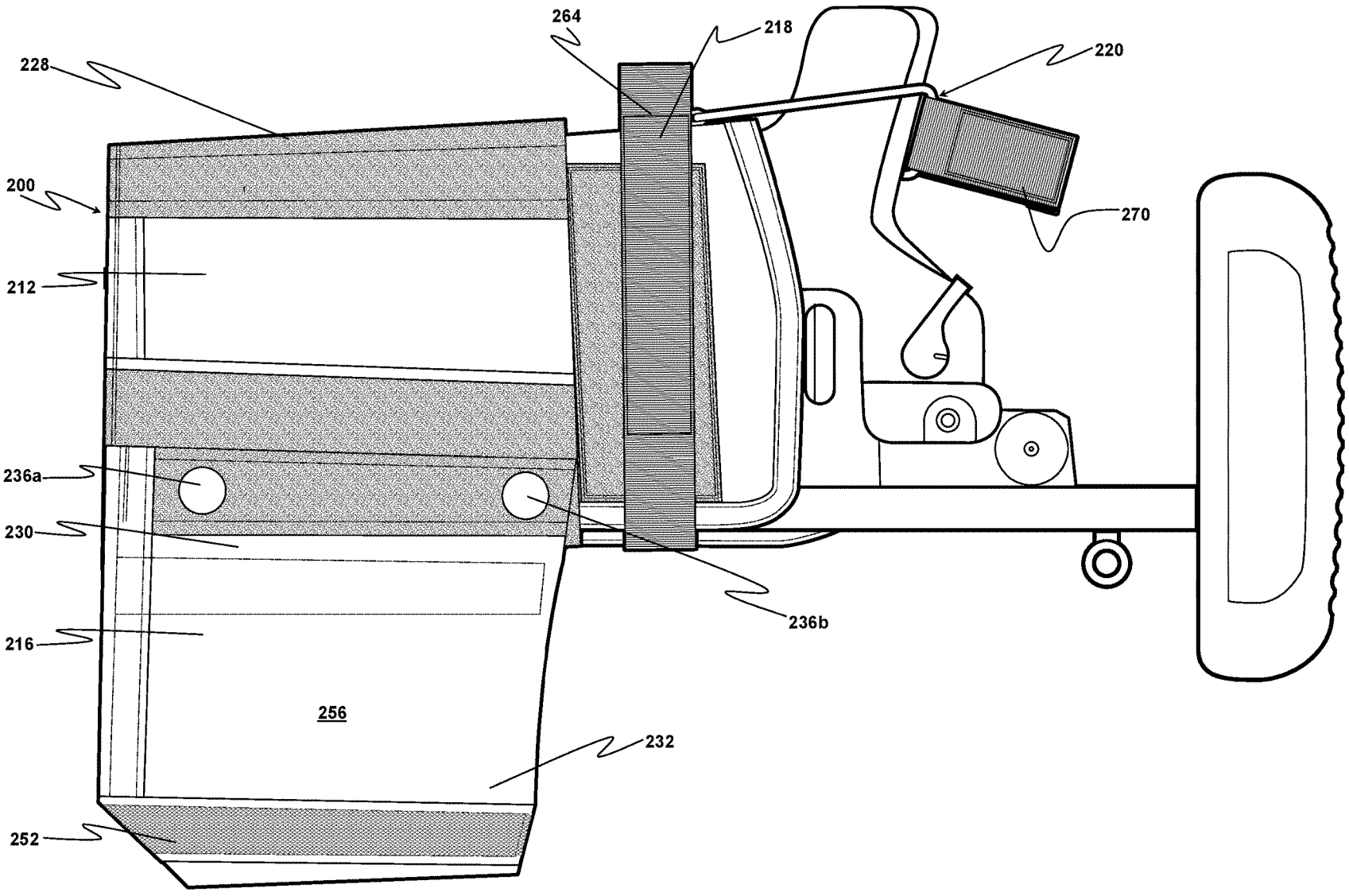
FIG. 10 shows a perspective view of a second embodiment of the weapons retention device with a weapon place therein.
Figure 11:
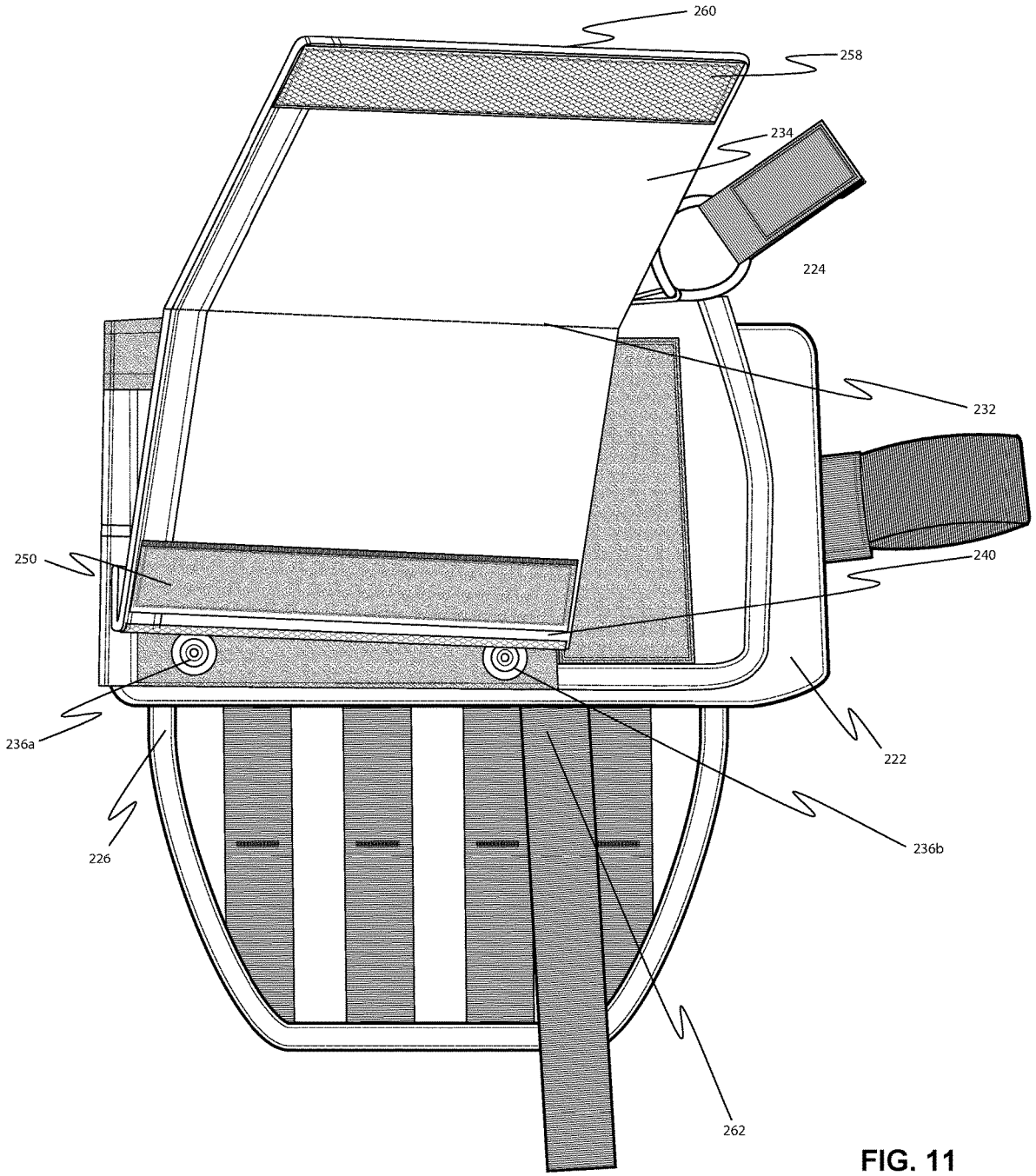
FIG. 11 shows a perspective view of the second embodiment with the sight cover removed.
Figure 12:
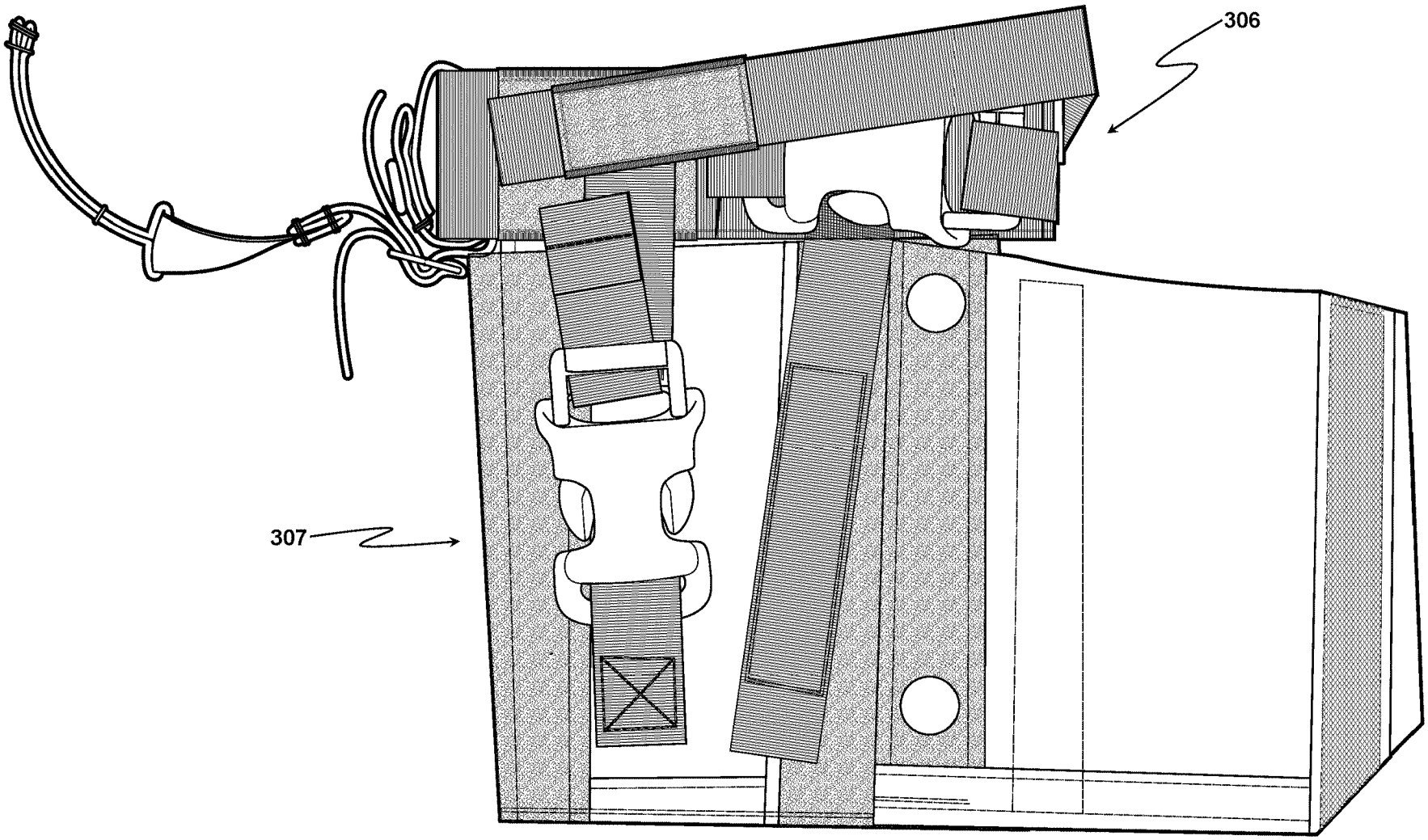
FIG. 12 shows a perspective view of a third embodiment of the weapon retention device.
Figure 13:
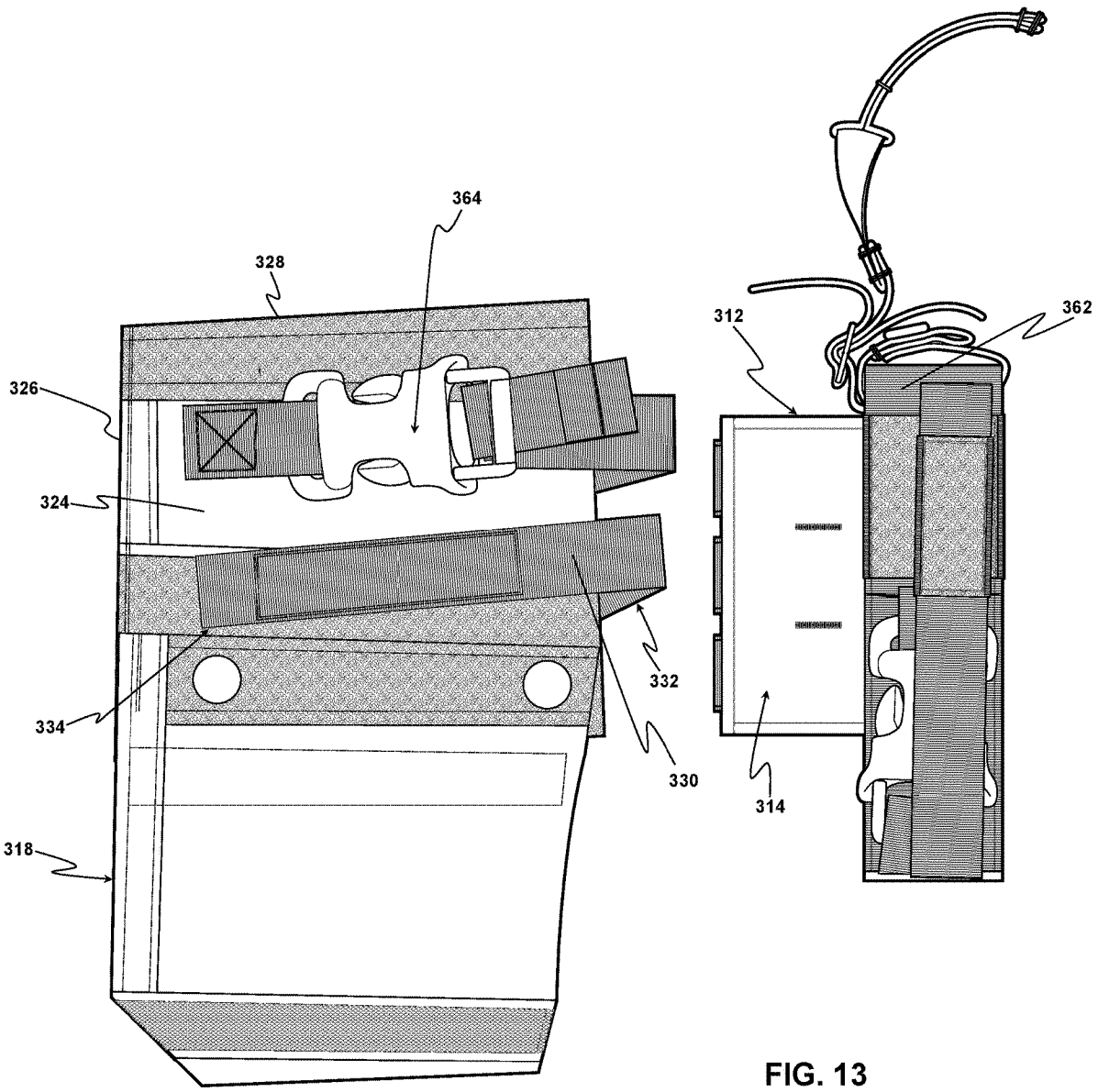
FIG. 13 shows a perspective view of the third embodiment with the breakaway portion removed from the clamp portion.
Figure 14:
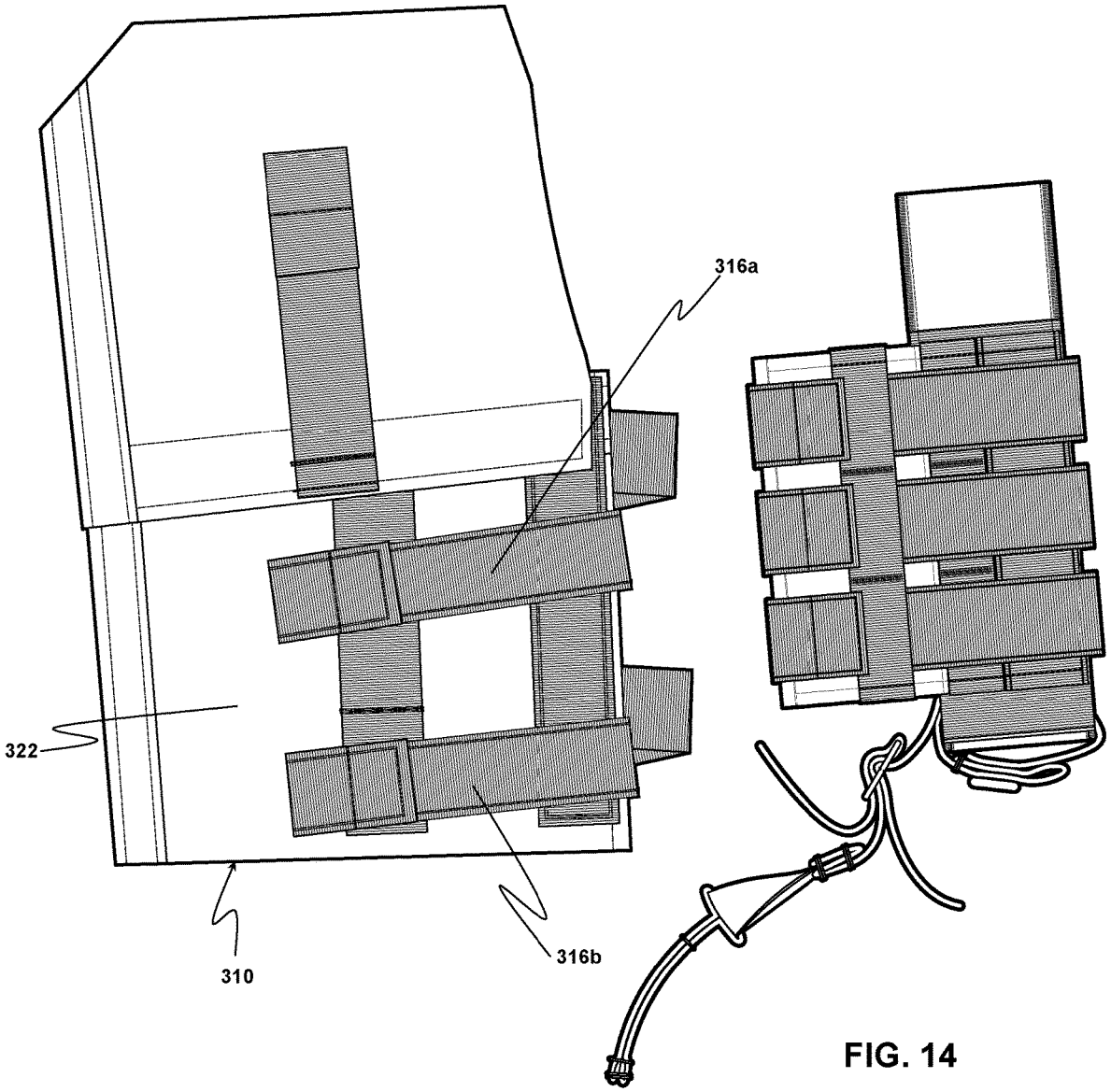
FIG. 14 shows a perspective view of the reverse side of the weapons retention device of that shown in FIG. 13.
Figure 15:
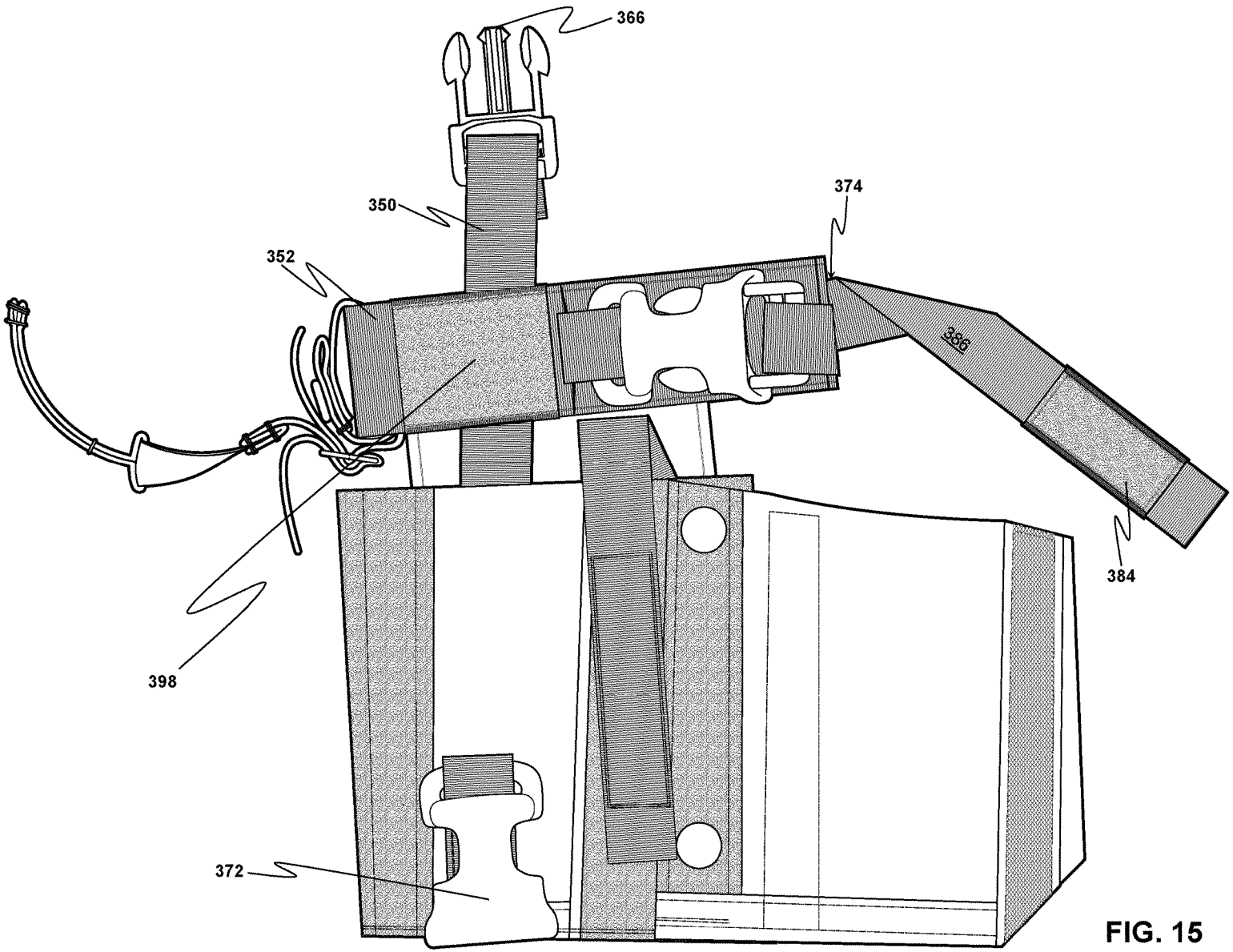
FIG. 15 shows a perspective view of the third embodiment with the breakaway portion partially attached to the clamp portion.
Figure 16:
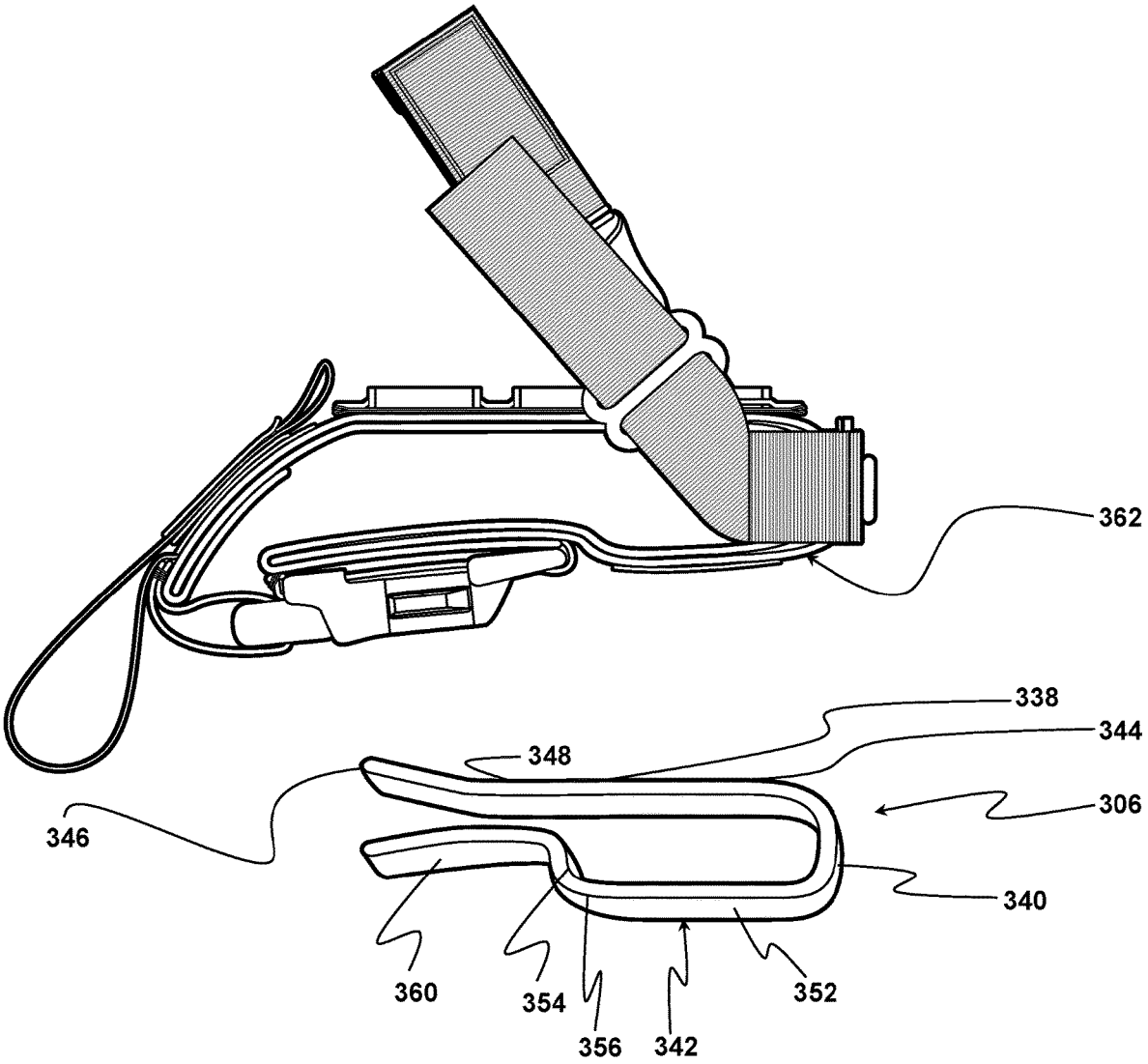
FIG. 16 shows a perspective view of the clamp removed from the clamp cover of the third embodiment.

The detailed description set forth below in connection with the appended drawings is intended as a description of the presently preferred embodiment of a first aid kit, and is not intended to represent the only form in which it can be developed or utilized. The description sets forth the functions for developing and operating the system in connection with the illustrated embodiments. It is to be understood, however, that the same or equivalent functions may be accomplished by different embodiments that are also intended to be encompassed within the scope of the present disclosure. It is further understood that the use of relational terms such as first, second, distal, proximal, and the like are used solely to distinguish one from another entity without necessarily requiring or implying any actual such relationship or order between such entities.

Disclosed herein is a weapons retention device 10 for wear on the person. In a first embodiment, the weapons retention device 10 may include a mounting panel 12, an open-ended clamp 14, a primary fastener 16, a secondary fastener 18, and a grip retention 20.

The mounting panel 12 may be made of a flexible material, for example a natural or synthetic cloth. The material may be doubled over and attached to itself to increase the strength of the mounting panel 12. The mounting panel 12 may be attached to itself by, for example, sewing at a plurality of locations. For example, when the mounting panel 12 is substantially square, the attachment panel may be sewn in a continuous pattern near an edge of each side of the square. A plurality of attachment straps 22*a-c* may be attached to the mounting panel 12. The plurality of attachment straps 22*a-c* may be attached to the mounting panel 12 by a header 24. The plurality of attachment straps 22*a-c* may be attached by placing a first end portion 26*a-c* of the each of the plurality of attachment straps 22*a-c* between the mounting panel 12 and the header 24, and then sewing each of the first end portions of each of the plurality of attachment straps 22 and the header 24 to the attachment panel. A second end portion 28*a-c* of each of the plurality of attachment straps 22 may be formed in to tab hooks 92*a-c* by doubling the each of the end second end portions 28*a-c* over twice, and sewing the twice doubled over portion down. The sewing may be spaced apart from a second end 30*a-c* of each of the plurality of attachment straps 22. Although three attachment straps 22*a-c* are shown, it is understood that there may be as few as two attachment straps, or as many as 30 attachment straps.

The mounting panel 12 may have one or more hook strips 88*a*, 88*b* attached to an outside surface 90 of the mounting panel 12. The hook strips 88*a*, 88*b* may be oriented with a longitudinal axis substantially perpendicular to the plurality of attachment straps 22*a-c*. The hook strips 88*a*, 88*b* may be attached to the mounting panel 12 via sewing at intervals along the longitudinal axis of each hook strip 88*a*, 88*b*. The sewing may be applied so that the stitching runs perpendicular to the longitudinal axis of each hook strip 88*a*, 88*b*. For example, the first sewing may be near a first end, and then a second sewing at an interval, a third sewing after an interval substantially equal to the first, and a fourth sewing near a second end of each hook strip 88*a*, 88*b*. The intervals may be based on the width of the attachment straps 22*a-c*. That is, the interval may be wider than the width of the attachment straps 22*a-c* in order to allow the second end portion 28*a-c* of one of the plurality of attachment straps 22*a-c* to pass between the mounting panel 12 and the hook strip 88*a*, 88*b*. The tab hooks 92*a-c* may engage the hook strips 88*a*, 88*b* to attach the weapons retention device 10 to another piece of equipment. The attachment straps 22*a-c* and hook strips 88*a*, 88*b* may be used to engage to, for example a belt. The attachment straps 22*a-c* and hook strips 88*a*, 88*b* may have dimensions which conform to the Modular Lightweight Load-carrying Equipment (MOLLE) and Pouch Attachment Ladder System (PALS) standard, as is well known in the art.

The mounting panel 12 may be attached to a clamp cover 32. The clamp cover 32 may enclose a clamp 14.

The clamp 14 may be generally "U" shaped. The clamp may include a first side 36, a curved portion 38, and a second side 40. The first side 36 may include a first end 42, a free second end 44, and a generally planar body 46, the body 46 having a rectangular perimeter, the body extending between the first end 42 and second end 44. The body 46 of the first side 36 may be substantially straight, and the body 46 may connect to the curved portion 38 on the first end 42. The second side 40 of the clamp 14 may include a substantially straight first section 48 may extend from the curved portion 38. An angled second section 50 may extend from an end 52 of the first section 48. The angled second section 50 may extend toward the first side 36 of the clamp 14 so that the distance between the first side 36 and the second side 40, narrows. A third section 54 of the second side 40 may extend from the second section 50. The third section 54 may be substantially straight and therefore be substantially parallel to the first side 36 of the clamp 14. Alternatively the free end portion of the first side 36 and the third section 54 may angle away from one another.

The clamp 14 may be made from a plastic, for example, kydex, or a metal, for example, aluminum. As long as the material is rigid enough to support the weight of the weapon being retained, and flexible enough to allow drawing of the weapon from, and return of the weapon to, the clamp 14, that material is contemplated by this disclosure.

The clamp cover 32 may have dimensions slightly larger than the clamp 14 over the second side 40 and the curved portion 38 so that the edges of the clamp cover 32 may be sewn closed in order for the clamp cover 32 to enclose the clamp 14.

The portion of the clamp cover 32 enclosing the curved portion 38 of the clamp 14 may have a pair of flaps. The pair of flaps may include a first flap 100, and an opposing second flap 102. The first flap 100 may have a first portion of a hook and loop fastener, and the second flap 102 may have a second portion of a hook and loop fastener, the second portion configured to engage with the first portion of the hook and loop fastener. The first flap 100 and the second flap 102 define an opening 104. The clamp 14 may be removed by pulling the clamp 14 through the opening 104. Likewise, the clamp 14 may be inserted by orienting the clamp sides to the corresponding sides of the clamp cover 32, and inserting the clamp 14 through the opening 104. This allows for full field maintenance of the clamp 14. If the clamp 14 should crack or break, or otherwise become unserviceable, the clamp 14 may be replaced and the weapons retention device 10 put back in to service.

The portion of the clamp cover 32 enclosing the curved portion 38 of the clamp 14 may further have a wrap strap 116 to secondarily secure the hook and loop fastener of the first flap 100 and second flap 102. The wrap strap 116 may have a length dimension sufficient for the wrap strap 116 to wrap the clamp 14 and clamp cover 32 perpendicular to a longitudinal axis of the clamp 14 and clamp cover 32 with some overlap of a first end portion 118 and a second end portion 120 of the wrap strap 116. The wrap strap 116 may be attached to the clamp cover 32. The wrap strap 116 may be attached to the portion of the clamp cover 32 which covers the curved portion 38 of the clamp 14. The wrap strap 116 may be attached to the clamp cover 32 on an inside surface 122 at a middle portion of the wrap strap 116. The first end portion 118 of the wrap strap 116 may have a first portion 124 of a mechanical fastener attached. The second end portion 120 of the wrap strap 116 may have a second portion 126 of a mechanical fastener attached. When the first end portion 118 and the second end portion 120 are overlapped, they first portion 124 and the second portion 126 of the mechanical fastener may be engaged. The engagement of the mechanical fastener causes the wrap strap 116 to abut the first flap 100 and second flap 102 over the hook and loop fastener attached to the first flap 100 and second flap 102, holding the hook and loop fastener in place. Alternatively, the wrap strap may have a hook and loop fastener rather than a mechanical fastener.

The clamp cover 32 may include an extended portion 56 which extends past the free second end 42 of the first side 36. The extended portion 56 may include an inside surface 60 and an outside surface 62. The extended portion 56 may have a flap of material folded over and attached back to the inside surface 60 of the extended portion 56 to add some rigidity to an end portion 58 of the extended portion 56. Alternatively, the flap of material may be folded over and attached back to the outside surface 62 of the extended portion 56. The end portion 58 may enclose a plastic liner to add rigidity to the end portion 58.

A loop 64, including a first end portion and a second end portion may be passed through a first portion 66 of a primary fastener 16. The first end portion and the second end portion may be sandwiched between a portion of hook and loop fastener 70 and the outside surface 62 of the extended portion 56. The portion of hook and loop fastener 70 and the first end portion and the second end portion may be attached to the outside surface 62 of the extended portion 56. The attachment may be accomplished, by, for example, by sewing. The loop 64 may be placed so that the first portion 66 of the primary fastener 16 is at an angle to a longitudinal axis 72 of the extended portion 56. Alternatively, the loop 64 may be placed so that the first portion 66 of the primary fastener 16 is parallel with the longitudinal axis 72 of the extended portion 56. Still further alternatively, the loop 64 may be placed so that the first portion 66 of the primary fastener 16 is co-axial with the longitudinal axis 72 of the extended portion 56. The primary fastener 16 may be a mechanical fastener, for example, a buckle. Alternatively, the primary fastener 16 may be a hook and loop fastener.

A secondary retention strap 74 may include a first end portion 76 and a second end portion 78. The second end portion 78 may include a first portion of hook and loop fastener 80 on an outside surface 82 of the secondary retention strap 74. The secondary retention strap 74 may be folded back so that the first portion of hook and loop fastener 80 may be engaged with the portion of hook and loop fastener 70. The second end portion 78 may also include a second portion of hook and loop fastener 84 on an inside surface 86. The first end portion 76 of the secondary retention strap 74 may also be sandwiched between a portion of hook and loop fastener 70 and the outside surface 62 of the extended portion 56. The portion of hook and loop fastener 70 and the first end portion 76 may be attached to the outside surface 62 of the extended portion 56. The attachment may be accomplished, by, for example, sewing. The secondary retention strap 74 may be placed so that the secondary retention strap 74 is at an angle to a longitudinal axis 72 of the extended portion 56. Alternatively, the secondary retention strap 74 may be placed so that the secondary retention strap 74 is parallel with the longitudinal axis 72 of the extended portion 56. Still further alternatively the secondary retention strap 74 may be placed so that secondary retention strap 74 is co-axial with the longitudinal axis 72 of the extended portion 56.

The mounting panel 12 may be attached to the clamp cover 32 on the portion of the clamp cover 32 enclosing the first side 36 of the clamp. The mounting panel 12 may have a dimension in width greater than that of the clamp cover 32, and thus may extend past either longitudinal edge of the clamp cover 32. These dimensions allow for the mounting panel 12, and the attachment straps 22, and hook strips 88 connected to it, to have dimensions which conform to the MOLLE/PALS standard or accommodate wider belts or straps.

The portion of the clamp cover 32 enclosing the third section 54 of the second side 40 may have a second portion 94 of the primary fastener 16 attached to an outside surface. The second portion 94 of the primary fastener 16 may have a piece of material 96 running through enclosed areas of the second portion 94 of the primary fastener 16, and this piece of material 96 may be attached to the clamp cover 32 to attach the second portion 94 to the clamp cover 32. The piece of material 96 may be attached to the clamp cover 32 for example, by sewing. Alternatively, the piece of material 96 may be attached by adhesives or mechanical fasteners.

The portion of the clamp cover 32 enclosing the first section 50 of the second side 40 may have a portion 98 of hook and loop fastener attached to the outside surface. The portion 98 of hook and loop fastener is configured to engage with the second portion of hook and loop fastener 84 on an inside surface 86 of the secondary retention strap 74. The portion 98 of hook and loop fastener may be attached to the clamp cover 32 by, for example, sewing. Alternatively, the portion 98 may be attached by adhesives or mechanical fasteners.

The grip retention 20 may be attached to the clamp cover 32 on an inside surface 122 of the clamp cover 32 covering the curved portion 38 of the clamp 14. The grip retention 20 may include an adjustment strap 108, an elastic loop 110, a friction pad 112, and a pull tab 114.

The adjustment strap 108 may have a first strip 128, a second strip 130, and an adjustment buckle 132. The first strip 128 may have a first end portion 134 and a second end portion 136. The first end portion 134 may be attached to the clamp cover 32. The first end portion 134 may be attached to the clamp cover 32 on the inside surface. The first end portion 134 may be attached by sewing. The first end portion 134 sewing may be stitched through the wrap strap 116 to attach the first end portion 134 to the clamp cover 32. The second end portion 136 may extend substantially perpendicular to the longitudinal axis of the clamp 14. The second end portion 136 may be engaged with the adjustment buckle 132.

The second strip 130 may have a first end portion 138 and a second end portion 140. The first end portion 138 may be engaged with the adjustment buckle 132. The second end portion 140 may be attached to the elastic loop 110. The second end portion 140 may be attached to the elastic loop 110 by sewing the second end portion 140 to the elastic loop 110. Opposite the attachment of the second end portion 140 to the elastic loop 110, the friction pad 112 may be attached to the elastic loop 110. The friction pad 112 may be sewn to the elastic loop 110 on an inside surface of the elastic loop 110. An inside surface of the friction pad 112 may be textured in order to increase the coefficient of friction between the friction pad 112 and any surface which the friction pad abuts.

Directly opposite the friction pad 112 which is attached on the inside surface of the elastic loop 110, a pull tab 114 may be attached on an outside surface of the elastic loop 110. The pull tab 114 may have a first end portion 142 and a second end portion 144. The first end portion 142 may be attached to the elastic loop 110, for example, by sewing. The second end portion 144 may extend away from the elastic loop 110. The pull tab 114 may include more than one layer of fabric. The layers of fabric may be attached to one another, for example, by sewing. The sewing and layers in the construction of the pull tab 114 make the pull tab 114 easier to grip by thickening the pull tab 114 and increasing the coefficient of friction on the surface of the pull tab 114.

In operation, a user may manipulate the attachment straps 22*a-c* on the mounting panel 12 to attach the weapons retention device 10 to another piece of gear worn on the user's body. That piece of gear may include MOLLE/PALS construction, or it may not.

Once the weapons retention device 10 is attached, a weapon may be placed within the weapons retention device 10. With the primary fastener 16 and secondary fastener 18 disconnected, and the extended portion 56 of the clamp cover 32 moved out of the way of the open portion of the "U" shaped clamp 14, a weapon may be placed in the clamp 14. The weapon may be moved in to the clamp from the open end of the "U" shape toward the curved portion 38 of the clamp 14, until the weapon comes to rest against the curved portion 38. Alternatively, the weapon may be translated through the open space of the clamp muzzle first until the grip of the weapon comes to rest against the clamp 14. Because of the resilient nature of the clamp 14, the clamp 14 will abut the frame of the weapon. Because the clamp abuts the frame of the weapon providing a friction grip, the frame being specifically the part of the weapon which contains the action, the clamp alone provides some measure of retention.

In order to ensure retention of the weapon, a user may move the extended portion 56 across the open end of the "U" of the clamp. In this position, the first portion 66 and second portion 94 of the primary fastener 16 may be engaged. For example, when the primary fastener 16 is a buckle, as is shown in the drawings, the first portion 66 of the buckle and the second portion 94 of the buckle may be engaged. Alternatively, the primary fastener 16 may be a hook and loop fastener. At this point in the operation, the weapon is secured within the weapons retention deice 10.

However, movement can cause fasteners to disconnect. This means that having a single fastener can lead to failures. The probability of such a failure and loss of a weapon at a critical moment can be lowered by having multiple points of retention.

Thus, the secondary retention strap 74 may further provide retention for the weapon. If the second end portion 78, and, specifically, the first portion of hook and loop fastener 80 on an outside surface 82 of the secondary retention strap 74 is secured to the portion of hook and loop fastener 70, these can be disengaged by a user by pulling. The user may control the second end portion 78 so that the second portion of hook and loop fastener 84 on an inside surface 86 of the secondary retention strap 74 is moved to engage the portion 98 of hook and loop fastener attached to the portion of the clamp cover 32 covering the first section 50 of the second side 40 of the clamp 14. In doing so, the secondary retention strap 74 at least partially covers the primary fastener 16 to hold the engagement thereof, and the portion 98 of hook and loop fastener and the portion 98 of hook and loop fastener form the secondary fastener 18. Even if one of the primary fastener 16 or secondary fastener 18 were to become disengaged, the other would still allow for weapon retention In order to prevent movement of the weapon within the weapon retention device 10 which may cause pressure against either the primary fastener 16 or the secondary fastener 18, increasing the likelihood that either the primary fastener 16 or the secondary fastener 18 will release, and to provide additional retention, the grip retention 20 may be engaged with the grip of the weapon. The user may grip the pull tab 114 and manipulate the pull tab 114 until the end of the grip of the weapon, and any other desired portion of the grip passes through the elastic loop 110. The pull tab may be released, and the elastic in the elastic loop 110 will pull the friction pad 112 against the grip of the weapon. The friction pad 112 will prevent the elastic loop 100 from moving in relation to the grip. If the friction pad 112 is not held against the grip with sufficient force, or cannot be moved properly in place, the second end portion 136 of the first strip 128 and the first end portion 138 of the second strip 132 may be manipulated through the adjustment buckle 132 to short the length of the first strip 128 and second strip 130, thereby placing the elastic loop 110 and connected friction pad 112 in the proper position.

In order to draw the weapon, either of the grip retention 20 or secondary fastener 18 may first be disengaged. Then, the other of the grip retention 20 or secondary fastener 18, whichever, may be disengaged. Finally, the primary fastener 16 may be disengaged, and the weapon drawn from the clamp 14.

In a second embodiment, the weapons retention device 200 may include a retention loop 220, a frame cover 212, a sight cover 216, and retention strap 218.

The frame cover 212 may include a first side wall 222, a second side wall 224 opposing the first side wall 222, a muzzle wall 226 placed in between and connecting to, the first and second opposing side walls, and a bottom 228. The first side wall 22, second side wall 224, and bottom 228 may formed from a single integral piece of material. That piece of material may be attached around the perimeter of the muzzle wall 226. The muzzle wall 226 may be generally planar with two opposing curved ends, and two opposing straight sides. Alternatively, the muzzle wall 226 may have a perimeter with one straight end opposing a curved end, and two opposing straight sides. Still further Alternatively, the perimeter of the muzzle wall 226 may be substantially rectangular with rounded corners. The muzzle wall 226 may have an outer covering of a natural or synthetic cloth material surrounding a piece of material to pad the muzzle of the weapon. For example, the material may be a foam. The first side wall 222, second side wall 224, and bottom 228 may be connected to the perimeter of the muzzle wall 226, for example, by sewing. Alternatively, the first side wall 222, second side wall 224, and bottom 228 may be connected to the perimeter of the muzzle wall 226 by adhesives, or a mechanical fastener, for example, a zipper.

The frame cover 212 may enclose a clamp (not shown). The clamp may be substantially similar to the clamp described above in the first embodiment. The clamp may be contained in a enclosed pocket of the frame cover 212. The frame cover 212 may include stitching around the clamp, which prevents the clamp from moving relative to the frame cover 212. The stitching may extend across the first side wall 222, the second side wall 224, and the bottom 228. Alternatively, the stitching may extend only partially across the first side wall and second side wall. The stitching may be located on opposing sides of the clamp, to prevent movement of the clamp along a first axis. The shape of the frame cover 212, with the first side wall 222, the second side wall 224, and the bottom 228 corresponding to the first side, second side, and curved portion of the clamp, and may prevent the clamp from moving on an axis perpendicular to the first axis.

The sight cover 216 may be formed of a single integrated piece of cover material enclosing some padding. Similar to the muzzle wall 226, the sight cover 216 may have a covering of a natural or synthetic material enclosing the padding material. Again, similar to the muzzle wall 226, the sight cover 216 may have foam as a padding material. Seams may be stitched across the sight cover 216 for define a plurality of panels and to facilitate bending at the edges of the panels. The sight cover 216 may include a plurality of panels.

The sight cover 216 may include an attachment panel 230, a first cover panel 232, and a second cover panel 234. The attachment panel 230 may be narrower than the first cover panel or second cover panel. The attachment panel 230 serves to provide material for attaching one portion of at least one mechanical fastener 236*a*, 236*b*. The at least one mechanical fastener 236*a*, 236*b* may be, for example, a button. Although two mechanical fasteners 236*a*, 236*b* are shown in the drawings, it will be understood that there could be as few as one mechanical fastener, and as many as 20 mechanical fasteners. A second portion of the at least one mechanical fastener 236*a*, 236*b* are attached to the second side wall 224 of the frame cover 212. Thus, using the at least one mechanical fastener 236*a*, 236*b*, the sight cover 216 may be attached to the frame cover 212.

The sight cover 216 may have a shorter longitudinal dimension than the frame cover 212. This is because the sight cover 216 is sized and shaped to cover the optic on the weapon being retained. The optic, with rare exception, does not extend the entire length of the frame, leading to the sight cover 216 having a smaller longitudinal dimension than the frame cover 212. Of course, this has implications for the operation of this embodiment of the weapon retention device, as will be explained in detail below.

The first seam 240 defining the adjoined edges of the attachment panel 230 and the first cover panel 232 substantially aligns with an outside edge 238 of the second side wall 224 of the frame cover 212. The first seam 240 acts as a hinge, causing the attachment panel 230, and first cover panel 232 to rotate about the longitudinal axis of the first seam 240.

The first cover panel 232 may have two strips of hook and loop fastener. The first strip 250 may be located near the first seam 240 on an inside surface 254 of the first cover panel 232. The first strip 250 may have a longitudinal axis which is parallel to the longitudinal axis of the first seam 240. The second strip 252 may be located near the second cover panel 234 on an outside surface 256 of the first cover panel 232. The second strip 252 may have a longitudinal axis which is parallel to a fold line between the first cover panel 232 and the second cover panel 234.

The second cover panel 234 may have a third strip 258 of hook and loop fastener near an outer free edge 260 of the second cover panel 234 on the interior surface. The third strip 258 may have a longitudinal axis which is parallel to the longitudinal axis of the free edge 260. The third strip 258 may correspond to a hook and loop fastener attached to the first side wall 222. This hook and loop fastener, when engaged, provides a second attachment for the sight cover 216, preventing the sight cover 216 from moving relative to the frame cover 212.

The second cover panel 234 may include a first pull tab. The first pull tab may include a first end portion and a second end portion. The first end portion may be attached near an edge of the second cover panel 234 and may extend back toward an interior of the second cover panel 234. The second end portion of pull tab may be free for grasping by a user.

A mounting panel 211 may be attached to the first side wall 222 of the frame cover 212. The mounting panel 211 may be substantially similar in structure to the mounting panel described above in the first embodiment. The mounting panel 211 may be attached to the first side wall 22 by, for example, sewing the mounting panel 211 to the first side wall 222 just inside a perimeter of the mounting panel 211. Alternatively, the mounting panel 211 may be attached to the first side wall 222 using adhesives or mechanical fasteners.

A retention strap 218 may provide addition retention for a weapon placed in the weapon retention device 210. The retention strap 218 may be a substantially rectangular strip of material with the strip's length much greater than its width. The retention strap 218 may include a first end portion 262 and a second end portion 264. The first end portion 262 may be attached to the first side wall 222. The first end portion 262 may be attached to the first side wall 222 by, for example, sewing. Alternatively, the first end portion 262 may be attached to the first side wall 222 using adhesives or mechanical fasteners. The second end portion 264 may have a hook and loop fastener portion 266 on one surface. The hook and loop fastener portion 266 may engage with either a hook and loop portion on the first side wall 222, or a hook and loop portion on the second side wall 224. When attached to the hook and loop portion on the first side wall 222, the retention strap 218 is pulled back out of the way of the open space 268 defined by the outside edges of the first side wall 222 and the second side wall 224.

The weapons retention device 200 may further include a retention loop 220. The retention loop 220 may be made from an elastic material. The retention loop 220 may be attached by a material strip wrapped around the retention loop, which is then attached, for example, by sewing, to the bottom 228. The retention loop 220 may also have a second pull tab 270 which is also formed from a material strip wrapped around the retention loop 220. However, the second pull tab 270 is not attached to any other portion of the weapons retention device 200.

In operation, a user may ensure the that retention strap 218 is attached to the hook and loop portion on the first side wall 222. This position keeps the retention strap 218 out of the way as the weapon is placed in the frame cover 212 and sight cover 216. Because the clamp 214 is enclosed by the frame cover 212, the clamp 214 engages and retains, in part, the weapon. Next, a user may remove the retention strap 218 from the attachment to the hook and loop portion on the first side wall 222. Then, the user may attach the retention strap 218 to the portion of the hook and loop fastener on the second side wall 224. This puts the retention strap 218 in attachment with the first side wall 222 on the first end portion 262, for example, by sewing, and the second end portion 264 with the second side wall 224 to put the retention strap 218 in tension and increase the clamping force of the clamp 214. Next, the user may grasp the second pull tab 270, and pull on the retention loop 220 to extend it, and place the retention loop 220 over the grip of the weapon. The elastic material of the retention loop 220 puts the retention loop 220 in tension, and pulls the weapon down in to the clamp 214. Thus, if the user accidently puts force against the weapon either in the upward direction or toward the open portion of the clamp 214, the retention loop 220 or retention strap 218, respectively counters that force, and aids in retaining the weapon in the weapon retention device 200. Because the sight cover 216 has a shorter longitudinal dimension than the frame cover 212, it facilitates the drawing of the weapon by allowing forward movement of the weapon out of the weapon retention device 200 in addition to the upward movement of the draw stroke.

In order to draw the weapon from the weapon retention device 200, the order of the above may be reversed. The user may first grasp the second pull tab 220 and increase the tension on the retention loop 220 and remove the retention loop 220 from the grip of the weapon. The retention loop 220 may be left hanging on the exterior of the frame cover 212 via the attachment of the retention loop 220 to the frame cover 212. Next, the user may grasp the retention strap 218 and disengage the attachment of the hook and loop fastener. The retention strap 218 may be either left to hang by the attachment to the first side wall 222, or the second end portion 264 may be attached to the hook and loop portion on the first side wall 222. Alternatively, the retention strap 218 may be removed before the retention loop 220. The user may then grasp the grip of the weapon and draw it, applying an upward and outward force sufficient to disengage the weapon from the clamp 214.

In addition, the sight cover 216 may either be moved from a first position, described above, to a second position, where the sight cover 216 is retained on the frame cover 212. In doing so, the sight cover 212 is folded in a "Z" pattern. The first pull tab may be grasped by a user and pulled to disengage the hook and loop fastener consisting of the third strip 258 and corresponding hook and loop fastener attached to the first side wall 222. As described above, this hook and loop fastener, when engaged, provides a second attachment for the sight cover 216, preventing the sight cover 216 from moving relative to the frame cover 212. Once disengaged, the sight cover 216 can move relative to the frame cover 212, specifically, by rotating around the first seam 240.

With the hook and loop fastener disengaged, the sight cover is only attached to the first side wall 222 by the at least one mechanical fastener 236*a*, 236*b*. The first cover panel 232 may be rotated around the first seam 240 so that the first cover panel 232 covers the attachment panel 230. The second strip 252 on the outside surface 256 of the first cover panel 232 may be attached to a corresponding piece of hook and loop fastener on the first side wall 222. This attaches the first cover panel 232 substantially parallel to the first side wall 222. The second cover panel 234 may then be rotated around the fold line 242 so that the second cover panel 234 covers the first cover panel 232. The third strip 258 on the second cover panel 234 may then be connected to the first strip 250 on the first cover panel 232, which holds the first cover panel 232 down to the second cover panel 234.

Alternatively, the sight cover 216 may be removed entirely. The sight cover 216 may be folded as described above, or not. Neither is required. However, the at least one mechanical fastener 236*a*, 236*b* may be disengaged from the first side wall 222, which removes the sight cover 216 from the weapon retention device 200. The weapon retention device 200 may be used either with or without the sight cover 216, based on user preference. Removing the sight cover 216 allows a more outward draw stroke, but also removes the protection provided by the weapon retention device 200 for the sight.

A third embodiment may be a combination of the first and second embodiments. Specifically, the third embodiment may include all of the structure of the first embodiment described above. The third embodiment may further include all of the structure of the second embodiment, a breakaway portion 307, below a clamp portion 306.

In the third embodiment, the mounting panel 312, which is substantially similar to the mounting panel 12, may further include a first portion of MOLLE fastener 314 on the interior surface of the mounting panel 312. This first portion of MOLLE fastener 314 may engage with a second portion of MOLLE fastener 316*a*, 316*b* on a first side wall 322 of the frame cover 310. Alternatively, the fastener may be hook and loop instead of MOLLE. The first side wall 322, in the remainder of the frame cover 310 is shorter in a longitudinal dimension than that of the second embodiment, because the frame cover 310 includes the portion only below the clamp portion 314. However, the frame cover 310 is substantially the same as the portion of the frame cover 212 below the clamp in the second embodiment. The frame cover 310 may also have a first side wall 322, second side wall 324, which opposes the first side wall, a muzzle wall 326, and a bottom 328. Again, each of these components is substantially similar to the portion of the analogous components below the clamp in the second embodiment. The third embodiment of the weapon retention device 300 may also have a sight cover 318. The sight cover 318 is substantially similar to the sight cover described above in relation to the second embodiment.

However, the second side wall 324 may have a wrap loop 330 which includes a first end portion 332 and a second end portion 334. The first end portion 332 may be attached to the second side wall 324, for example, by sewing the first end portion 332 to the second side wall 324. The second end portion 334 may include a first portion of a hook and loop fastener. A second portion of the hook and loop fastener may be located on the second side wall 324, or on a clamp cover 362 underneath a primary fastener 336, which is substantially similar to the primary fastener of the first embodiment. The wrap loop 330 may extend past a top edge of the second side wall 324 with enough length to overlap a portion of the clamp cover 362. The wrap loop 330 may wrap around a top edge of the clamp cover 362 and then be passed through an opening between the clamp cover 362 and the portion of the primary fastener 336 attached to the clamp cover 362. The wrap loop 330 may then pass over itself and attach to a second portion of hook and loop fastener attached to the second side wall 324.

When attached, the hook and loop fastener, along with the MOLLE fastener on the mounting panel 312, may prevent the frame cover 310 from moving relative to the clamp 306. Alternatively, rather than a hook and loop faster, the wrap loop 330 may be attached to the clamp cover 362 with a mechanical fastener.

Alternatively, or in addition, the second side wall 324 may have an attachment tab 350. The attachment tab 350 may have a first portion of a mechanical fastener. The mechanical fastener may be a mechanical fastener, for example, a side lock buckle or a button. The second portion of the mechanical fastener may be attached to the second side with the attachment tab 350 looping up and over the clamp. The mechanical fastener 364 with a first portion 366 and a second portion 372, when attached, may hold the attachment tab 350 in place.

Similar to the first and second embodiments, the clamp 306 of this embodiment may have a generally "U" shape. The clamp may include a first side 338, a curved portion 340, and a second side 342. The first side 338 may include a first end 344, a free second end 346, and a generally planar body 348, the body 348 having a rectangular perimeter, the body extending between the first end 344 and second end 346. The body 348 of the first side 338 may be substantially straight, and the body 348 may connect to the curved portion 340 on the first end 344. The second side 342 of the clamp 306 may include a substantially straight first section 352 may extend from the curved portion 340. An angled second section 354 may extend from an end 356 of the first section 352. The angled second section 354 may extend toward the first side 338 of the clamp 306 so that the distance between the first side 338 and the second side 342, narrows. A third section 360 of the second side 342 may extend from the second section 354. The third section 360 may be substantially straight and therefore be substantially parallel to the first side 338 of the clamp 306.

Also similar to the first embodiment, the portion of the clamp cover 362 enclosing the first section 352 of the second side 342 may have a first portion 398 of hook and loop fastener attached to the outside surface. The portion 398 of hook and loop fastener is configured to engage with the second portion of hook and loop fastener 384 on an inside surface 386 of a secondary retention strap 374. The first portion 398 of hook and loop fastener on the first section 352 may be attached to the clamp cover 362 by, for example, sewing.

Alternatively, the attachment tab 350 may have two portions of hook and loop fastener. A second portion may be on an inside surface of the attachment tab 350, and be configured to engage the portion 398 on the first section 352. The engagement of the second portion and the first portion 398 secures the frame cover 310 to the clamp cover 362. The attachment tab 350 may have a third hook and loop fastener portion on an outer surface of the attachment tab 350. The third portion 376 is configured to engage with the secondary retention strap 374. Thus, the attachment tab 350 is—partially sandwiched between the hook and loop on the clamp cover and the hook and loop on the secondary retention strap 374.

Alternatively, the weapon retention device 300 may have both attachments. Although one attachment is sufficient, two may provide extra security to the weapon retention device 300.

The above description is given by way of example, and not limitation. Given the above disclosure, one skilled in the art could devise variations that are within the scope and spirit of the invention disclosed herein, including various ways of defining the commands in the protocol. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A weapon retention device for carrying a weapon on a person, comprising:
   - a clamp including:
     - a first side, the first side being substantially planar;
     - a second side having a first straight section and a second straight section, with an angled section connected to, and between the first straight section and the second straight section, the angled section causing the second section to be closer to the first side than the first section;
     - a curved portion connecting the first side and the second side; and
     - the first side and second side defining an open end;
   - a secondary retention strap attached to the first side of the clamp, and the secondary retention strap having a fastener for selectably engaging on the second side of the clamp;
   - a mounting panel attached to the clamp, the mounting panel including a plurality of straps for attaching the weapon retention device to other equipment; and
   - a grip loop attached to the clamp, the grip loop being made of an elastic material and sized to allow a user to grasp the grip loop and move it to surround a grip of a weapon;
   - wherein, when the weapon is placed in the clamp, the clamp provides a friction force on the frame and trigger guard of the weapon, the secondary retention strap engaged with the second side of the clamp so that the secondary retention strap crosses the open end, and the grip loop moved to surround and abut the grip of the weapon.

2. The weapon retention device of claim 1, further comprising a primary fastener, a first portion of the primary fastener attached to the second straight section and a second portion of the primary fastener is attached to an extended portion of a clamp cover, the extended portion extending past an end of the first side.

3. The weapon retention device of claim 1, further comprising a frame cover enclosing the clamp, the frame cover including a first side wall, opposing second side wall, a bottom connecting the first side wall and second side wall, and a muzzle wall connected to a first edge of the first side wall, a second edge of the bottom, and a third edge of the second side wall.

4. The weapon retention device of claim 3, further comprising a sight cover connected to the frame cover.

5. The weapon retention device of claim 4, wherein the sight cover may be moved from a first position where the sight cover covers a sight of the weapon to a second position where the sight cover does not cover the sight of the weapon, and the sight cover is attached to the frame cover using a "Z" fold.

6. The weapon retention device of claim 4, wherein the sight cover may be detached from the frame cover entirely.

7. The weapon retention device of claim 1, further comprising a frame cover attached to the clamp, the frame cover including a first side wall, opposing second side wall, a bottom connecting the first side wall and second side wall, and a muzzle wall connected to a first edge of the first side wall, a second edge of the bottom, and a third edge of the second side wall.

8. The weapon retention device of claim 7, further comprising a sight cover attached to the frame cover.

9. The weapon retention device of claim 8, wherein the sight cover may be moved from a first position where the sight cover covers a sight of the weapon to a second position where the sight cover does not cover the sight of the weapon, and the sight cover is attached to the frame cover using a "Z" fold.

10. The weapon retention device of claim 7, further comprising a hook and loop fastener including a first fastener portion on the mounting panel, and a second fastener portion on the first side wall.

11. The weapon retention device of claim 1, further comprising a clamp cover enclosing the clamp.

12. The weapon retention device of claim 11, wherein the clamp cover includes an opening where the clamp can be removed from the clamp cover.

13. The weapon retention device of claim 12, wherein the opening may be closed by at least one flap, the at least one flap having a portion of a fastener attached.

14. The weapon retention device of claim 1, wherein the grip loop includes a friction pad.

15. A method for manufacturing a weapon retention device, comprising:

forming a clamp, the clamp including:

a first side, the first side being substantially planar;

a second side having a first straight section and a second straight section, with an angled section connected to, and between, the first straight section and the second straight section, the angled section causing the second section to be closer to the first side than the first section;

a curved portion connecting the first side and the second side and the first side and second side defining an open end;

attaching a secondary retention strap to the first side of the clamp, the secondary retention strap having a fastener for selectably engaging on the second side of the clamp;

attaching a mounting panel to the clamp, the mounting panel including a plurality of straps for attaching the weapon retention device to other equipment; and attaching a grip loop to the clamp, the grip loop being made of an elastic material and sized to allow a user to grasp the grip loop and move it to surround a grip of a weapon;

wherein, when the weapon is placed in the clamp, the clamp provides a friction force on the frame and trigger guard of the weapon, the secondary retention strap engaged with the second side of the clamp so that the secondary retention strap crosses the open end, and the grip loop moved to surround and abut the grip of the weapon.

16. The method of claim 15, further comprising a attaching a primary fastener to the weapon retention device, a first portion of the primary fastener attached to the second straight section and a second portion of the primary fastener is attached to an extended portion of a clamp cover, the extended portion extending past an end of the first side.

17. The method of claim 15, further comprising attaching a frame cover to the clamp, the frame cover including a first side wall, opposing second side wall, a bottom connecting the first side wall and second side wall, and a muzzle wall connected to a first edge of the first side wall, a second edge of the bottom, and a third edge of the second side wall.

18. The method of claim 15, further comprising enclosing the clamp in a frame cover.

19. The method of claim 18, further comprising attaching a sight cover to the frame cover.

20. The method of claim 15, further comprising attaching a frame cover to the mounting panel and a clamp cover, the clamp cover enclosing the clamp.

* * * * *